US009624003B1

(12) United States Patent
Tseng et al.

(10) Patent No.: US 9,624,003 B1
(45) Date of Patent: Apr. 18, 2017

(54) BAG WITH GRIPPING BANDS

(71) Applicant: Inteplast Group, Ltd., Livingston, NJ (US)

(72) Inventors: Ben Tseng, Somerset, NJ (US); Jyh-yao Raphael Li, Parsippany, NJ (US); Kelvin Yang, Madison, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 14/951,134

(22) Filed: Nov. 24, 2015

(51) Int. Cl.
*B65D 33/16* (2006.01)
*B65D 33/25* (2006.01)
*B65D 33/24* (2006.01)

(52) U.S. Cl.
CPC ..... *B65D 33/2508* (2013.01); *B65D 33/24* (2013.01)

(58) Field of Classification Search
CPC ..... B65D 33/2508
USPC ..... 383/63, 65
See application file for complete search history.

(56) References Cited

U.S. PATENT DOCUMENTS

| | | | | |
|---|---|---|---|---|
| 3,371,696 | A * | 3/1968 | Ausnit | B29C 47/0026 24/DIG. 50 |
| 3,410,327 | A * | 11/1968 | Ausnit | B65D 33/2541 24/585.12 |
| 3,425,469 | A * | 2/1969 | Ausnit | B65D 33/2541 24/585.12 |
| RE27,174 | E * | 9/1971 | Ausnit | 24/DIG. 50 |
| 5,369,847 | A * | 12/1994 | Naya | B65D 33/2508 24/30.5 R |
| 6,854,886 | B2 | 2/2005 | Piechocki et al. | |
| 7,322,747 | B2 | 1/2008 | Borchardt | |
| 8,061,898 | B2 | 11/2011 | Pawloski et al. | |
| 8,215,839 | B2 | 7/2012 | Borchardt et al. | |
| 2005/0196076 | A1 * | 9/2005 | Tanaka | B65D 33/007 383/63 |

FOREIGN PATENT DOCUMENTS

| | | | |
|---|---|---|---|
| JP | 2000006997 | A * | 1/2000 |
| JP | 2007119043 | A * | 5/2007 |
| JP | 2008044616 | | 2/2008 |
| JP | 2008044616 | A * | 2/2008 |
| JP | 2012218746 | A * | 11/2012 |
| JP | 2012229022 | A * | 11/2012 |
| JP | 20122290222 | A | 11/2012 |
| WO | WO 2013069112 | A1 * | 5/2013 |

OTHER PUBLICATIONS

Machine translation of the description of JP 2007119043 A.*
Machine translation of the description of JP 2012218746 A.*

* cited by examiner

*Primary Examiner* — Jes F Pascua
(74) *Attorney, Agent, or Firm* — Senniger Powers LLP

(57) ABSTRACT

A bag and closure for a bag. The closure includes interlocking closure profiles that extend along the width of the closure and are selectively matable to close the closure or bag. The closure profiles are configured to be spaced apart from the top end of the bag. The closure further includes grip spacing formations that extend along the width of the closure. When the profiles mate, the grip spacing formations engage one another and urge opposing top end portions of the bag or closure outward to define an enlarged gap. The opposing top end portions, thus, define gripping bands that are accessible for being gripped during bag opening.

21 Claims, 8 Drawing Sheets

BAG WITH GRIPPING BANDS

FIELD

The present invention generally relates to plastic bags with closures and more specifically to a plastic bag with gripping panels for opening the bag.

BACKGROUND

Plastic bags are used for many different applications, such as shipping, food packaging, biohazard disposal, etc. Certain plastic bags are reclosable. Reclosable bags include a reclosable closing structure that can be used to selectively open and close the bag. It is desirable for the bag to have features for gripping when opening the reclosable closing structure.

SUMMARY

In one aspect, a closure for selectively closing a bag comprises first and second closure members. Each closure member comprises a support wall having a top end and a bottom end spaced apart along a height and a first side and a second side spaced apart along a width. An interlocking profile extends along the width of the respective support wall at a location spaced apart from the top end of the support wall. A grip spacing formation extends along the width of the support wall at a location spaced apart from the top end of the support wall. The support wall defines a grip segment extending between the top end of the support wall and the grip spacing formation. The interlocking profiles of the first and second closure members are configured for selective complementary interlocking engagement to close the closure. The grip spacing formations of the first and second closure members are sized and arranged for engaging one another and deflecting the grip segments of the first and second closure members outwardly apart from one another when the closure is closed to define an enlarged gap at the top ends of the support walls.

In another aspect, a bag has first and second sides spaced apart along a width and top and bottom ends spaced apart along a height. The bag comprises first and second panels joined together along the first and second sides and bottom ends of the first and second panels to define a bag interior and has top end portions that are not joined together to define a bag opening. Each of the first and second body panels comprises a gripping band extending along the width of the bag at the top end portion of the respective panel. An interlocking closure profile extends along the width of the bag and is spaced from the respective gripping band toward the bottom ends of the first and second panels. The interlocking closure profiles of the first and second panels are shaped and arranged for selective interlocking engagement to close the bag opening. A grip spacing formation extends along the first panel widthwise of the bag. The grip spacing formation is sized and arranged to engage the second panel and deflect the gripping band of the second panel away from the gripping band of the first panel to define an enlarged gap therebetween at the top end of the bag when the closure profiles are in interlocking engagement.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
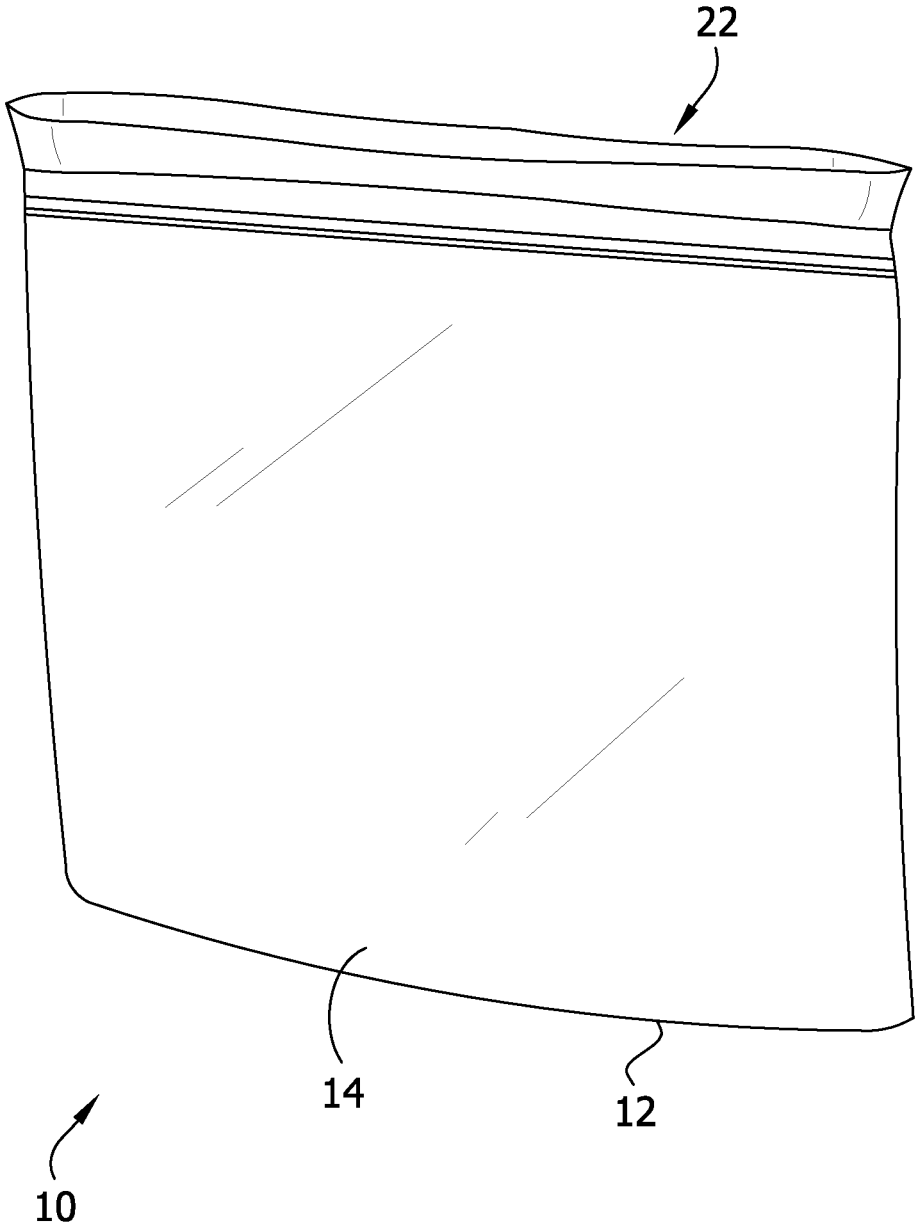
FIG. 1 is a perspective of a closed bag.
Figure 2:
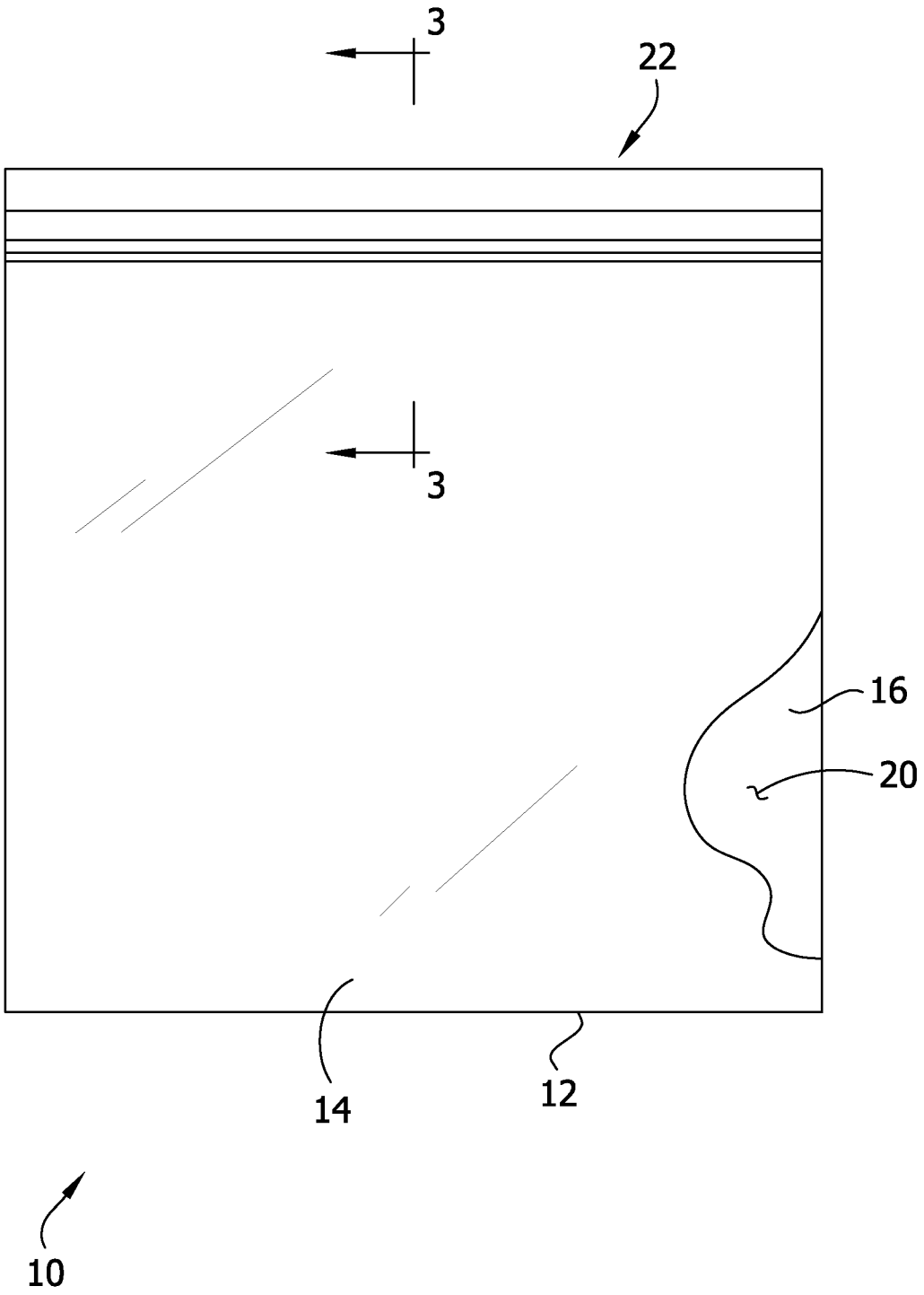
FIG. 2 is a front elevation of the bag.

Referring generally to the drawings, and particularly to FIGS. 1 and 2, one embodiment of a bag is generally indicated at reference number 10. As will be evident, the bag 10 includes features that make the bag easy to open. For example, upper margins of the bag 10 are laterally spaced apart from one another when the bag is closed to readily provide easy access for gripping when opening the bag.

The bag 10 includes a bag body 12 comprising front and rear panels 14, 16. As illustrated in the drawings, each of the panels has a top margin, bottom margin, and opposite side margins adjacent a top edge, bottom edge, and side edges, respectively (each of the margins is broadly an end margin). The panels 14, 16 are joined along their bottom margins and side margins to define a bag interior 20. In one embodiment, the panels 14, 16 are formed as a single sheet of material that is folded at the bottom of the bag body 12 along a linear fold, and the side margins are joined together along fusion lines. The panels can be formed and joined together in other ways without departing from the scope of the invention. For example, the panels can be formed as separate sheets and fused together along the bottom margin and side margins. Whether the panels 14, 16 are formed as one piece and folded over, or formed as two pieces, the end margins are considered to be joined together for purposes of this description. In some embodiments, the end margins are joined to form a fluid tight, liquid tight, and/or gas tight seal. In other embodiments, the end margins can be joined together without forming a seal.

The bag interior 20 is adapted to receive items placed within the bag 10. The top margins of the bag panels 14, 16 can be initially unsecured along their length to define an opening permitting access to the bag interior 20 and its contents. It will be understood that, though the top of the bag 10 defines the opening in the illustrated embodiment, in other embodiments, the sides or bottom of the bag can define the opening without departing from the scope of the invention. Preferably, corresponding end margins of joined panels can define an opening that can be opened and closed in accordance with the principles set forth below.

Figure 3:
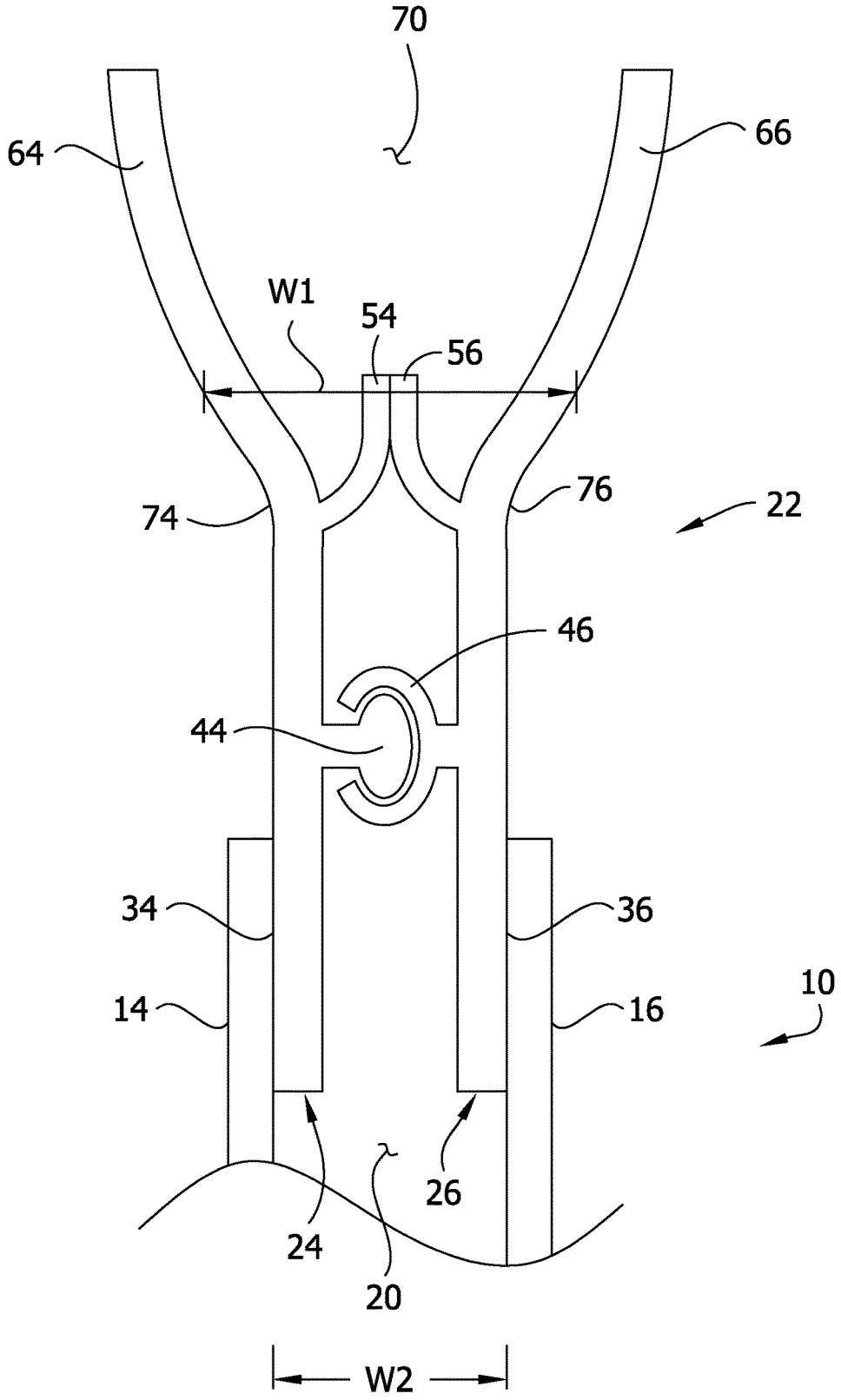
FIG. 3 is a fragmentary section taken in the plane of line 3-3 of FIG. 2.
Figure 4:
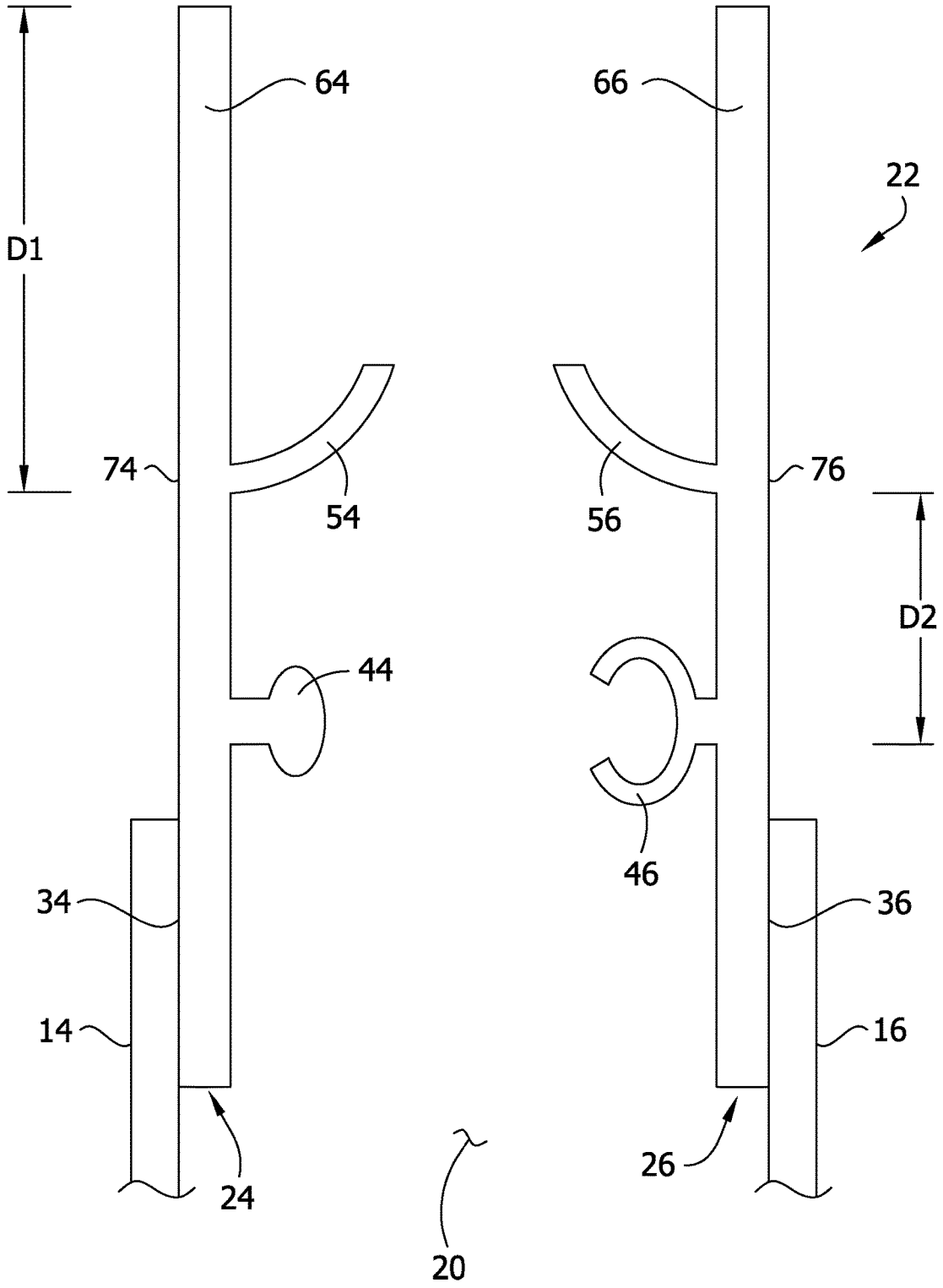
FIG. 4 is a fragmentary section similar to FIG. 3 of the bag in an open configuration.

The bag 10 further includes a closure, generally indicated at 22. Referring to FIGS. 3 and 4, the closure 22 includes front and rear closure members, generally indicated at 24, 26. Each closure member 24, 26, is appended to the top margin of a respective bag panel 14, 16 for selectively opening and closing the bag 10. Each closure member 24, 26 extends across the width of the bag body 12, and the illustrated closure members are joined together at their side margins. In a preferred embodiment, each closure member 24, 26 is a one-piece body of polymeric material formed, for example, in a profile extrusion process. But in certain embodiments, parts of the each closure member element 24, 26 can be formed of different materials and/or as separate pieces joined together without departing from the scope of the invention. In one embodiment, the closure members 24, 26 can be opaque. Preferably the closure members 24, 26 are appended to the bag panels 14, 16 after the bag body 12 is formed. But as discussed below, the closure members and bag body could also be formed together as one piece in, for example, an extrusion process without departing from the scope of the invention.

As shown in FIGS. 3 and 4, each closure member 24, 26 includes a support wall 34, 36 that is attached (e.g., adhered, fused, etc.) to a respective one of the bag panels 14, 16 to secure the closure member to the bag body 12. As shown in FIG. 4, each support wall 34, 36 has a height extending from a bottom end margin to a top end margin thereof. Each support wall 34, 36 also has a width extending the width of the bag body, from a first side of the support wall to an opposite second side. In the illustrated embodiment, a bottom margin of each support wall 34, 36 overlies a top margin of the bag panel 14, 16. But as discussed in further detail below, the top margin of the bag panels can, in other embodiments, extend above the top margins of the support walls. It will be understood that the support walls 34, 36 may be attached to the inside surface or the outside surface of the bag panels 14, 16.

Each of the closure members 24, 26 comprises an interlocking profile 44, 46. The interlocking profiles 44, 46 extend along the width of the respective support wall 34, 36 at a location spaced apart from the top end of the support wall. In the illustrated embodiment, the interlocking profile 44 is a single male connector and the interlocking profile 46 is a single female connector. In other embodiments, other numbers and types of profile connectors may be used without departing from the scope of the invention. For example, each closure member may comprise a male and female connector, etc. As shown in FIG. 3, the profile members 44, 46 are configured for selective complementary engagement to close the closure 22 and thereby close the bag 10. In a preferred embodiment, the interlocking profiles 44, 46 are configured to form a fluid tight, liquid tight, and/or gas tight seal when closed. In other embodiments, the interlocking profiles 44, 46 can be closed without forming a seal.

Each closure member 24, 26 further includes a grip spacing projection 54, 56 (broadly, a grip spacing formation). The grip spacing projections 54, 56 extend along the width of the respective support wall 34, 36 at a location spaced apart along the height of the support wall between the top end and the respective interlocking profile 44, 46. The grip spacing projections 54, 56 are generally aligned along the height of the bag 10 and closure 22. Each grip spacing projection 54, 56 is spaced apart from the top end of the respective support wall 34, 36 toward the bottom end of the support wall. The grip spacing projections 54, 56 are spaced apart from the top end of the support wall 34, 36 by a distance D1 and spaced apart from the respective interlocking profile 44, 46 by a distance D2. The distance D1 is preferably larger than the distance D2. Moreover, the distance D2 is preferably at least about 1.5 mm to provide space between the grip spacing projections 54, 56 and the interlocking profiles 44, 46 that prevents the grip spacing projections from interfering with engagement of the interlocking profiles. In the illustrated embodiment, the grip spacing projections 54, 56 are located at a lower end portion of a grip segment 64, 66 of the support walls 34, 36. As will be discussed in further detail below and as is illustrated in FIG. 3, the grip spacing projections 54, 56 are sized and arranged for engaging one another when the closure 22 is closed and thereby deflecting the grip segments 64, 66 outwardly apart from one another to define an enlarged gap 70 at the top ends of the support walls 34, 36. The enlarged gap makes it easier to insert one or more fingers into the gap for grasping the grip segments 64, 66.

In suitable embodiments, both of the grip spacing formations 54, 56 are projections that project inward from the respective support wall 34, 36. The illustrated projections 54, 56 curve upwardly toward a free end as they extend inwardly from the support walls 34, 36. In other embodiments, it is contemplated that one or both of the grip spacing projections could have a different configuration without departing from the scope of the invention. For example, it is specifically contemplated that projections of other shapes could be used instead of the curved projections 54, 56. Likewise, in one or more embodiments, only one of the grip spacing projections is a projection and the other is a flat surface of the support wall, whereby the projecting formation engages the flat formation in the closed position to urge the grip segment of the support wall outward. Still further, one of the grip spacing projections could be omitted.

Referring to FIG. 4, each grip spacing projection 54, 56 is resiliently biased toward a non-deflected position in which it extends inward from a respective joint 74, 76 with the support wall 34, 36. As shown in FIG. 3, when the closure 22 is closed, the grip spacing projections 54, 56 engage one another. Preferably, the grip spacing projections 54, 56 are sized and arranged for interfering engagement so that one or both of the grip spacing projections is deformed away from its undeformed position when the closure is closed. Thus, the engagement of the grip spacing projections 54, 56 deflects the grip spacing projections from the undeformed position (FIG. 4) to a deformed position (FIG. 3). In the illustrated embodiment, the engagement of the grip spacing projections 54, 56 deflects the free ends outward closer to the respective support wall 34, 36 than in the non-deflected position. In addition, when the interlocking profiles 44, 46 are closed, the engagement of the grip spacing projections 54, 56 deflects the portions of the support walls 34, 36 that are aligned along the height of the support walls with the grip spacing projections outward with respect to the portions of the support walls that are aligned along the height of the support walls with the interlocking profiles. For example, as shown in FIG. 3, the portions of the support walls 34, 36 that are aligned with the grip spacing projections 54, 56 are spaced apart a first width W1. The portions of the support walls 34, 36 that are aligned with the interlocking profiles 44, 46 are spaced apart a second width W2 that is smaller than the first width W1. For example, in one or more embodiments, the first width W1 is at least about 105% of the second width W2, preferably from about 105% to about 175%, or more preferably from about 110% to about 135%.

In a preferred embodiment, the grip segments 64, 66 are resiliently biased toward a non-deflected position. For, example, FIG. 4 shows grip segments 64, 66 biased toward a non-deflected position in which the support walls 34, 36 are substantially planar. The closure members 24, 26 are configured so that the deflection of the grip spacing projections 54, 56 imparts forces on the support walls 34, 36 that deflect the grip segments 64, 66 outward from the non-deflected position when the closure 22 is closed. In the illustrated embodiment, the joints 74, 76 form living hinges, and the grip segments 64, 66 are flexibly pivotable about the living hinges when the grip spacing projections 54, 56 engage one another. The grip segments 64, 66 bend away from each other at the living hinges 74, 76 to the deflected position shown in FIG. 3 so that the top end portions of the support walls 34, 36 define the enlarged gap 70.

In the illustrated embodiment, the grip segments 64, 66 define the top end portion of the bag 10 and form the portion of the bag that is grasped when opening the closure 22. Thus, in the illustrated embodiment, the grip segments 64, 66 form "gripping bands" shaped and arranged for being grasped when opening the bag 10. Throughout the disclosure, the term "gripping bands" refers to the structure that is configured for being grasped by the user. The term "grip segments" refers to a structure that is connected to a grip spacing formation and moved by it when the bag is closed. A "grip segment" can, itself, form the "gripping band" where, as here, it forms the portion of the bag configured to be grasped when opening the bag. Or in other embodiments, the "grip segment" can connected to a "gripping band" to orient the gripping band for being grasped when opening the bag in response to being moved into position by the grip spacing projection.

In the illustrated embodiment, when the closure 22 is closed, the gripping bands 64, 66 are spaced apart from one another by the enlarged gap 70, which is sized for receiving a user's finger (e.g., a thumb or forefinger) therein. Thus, as compared with conventional reclosable bags, the illustrated bag 10 is configured to position the gripping bands to be more maneuverable and reachable when opening the bag. Moreover, the living hinges 74, 76 enable the user to orient the gripping bands 64, 66 to impart an opening force on the closure 22 in a range of directions (e.g., more upwardly when pulled in the orientation shown in FIG. 3 or more outwardly when pivoted about the living hinges 74, 76 to a more outward orientation (not shown)). This feature can be used in combination childproof closure profiles that restrict opening unless force is imparted on the closure profiles in a specific, predetermined direction.

Figure 5:
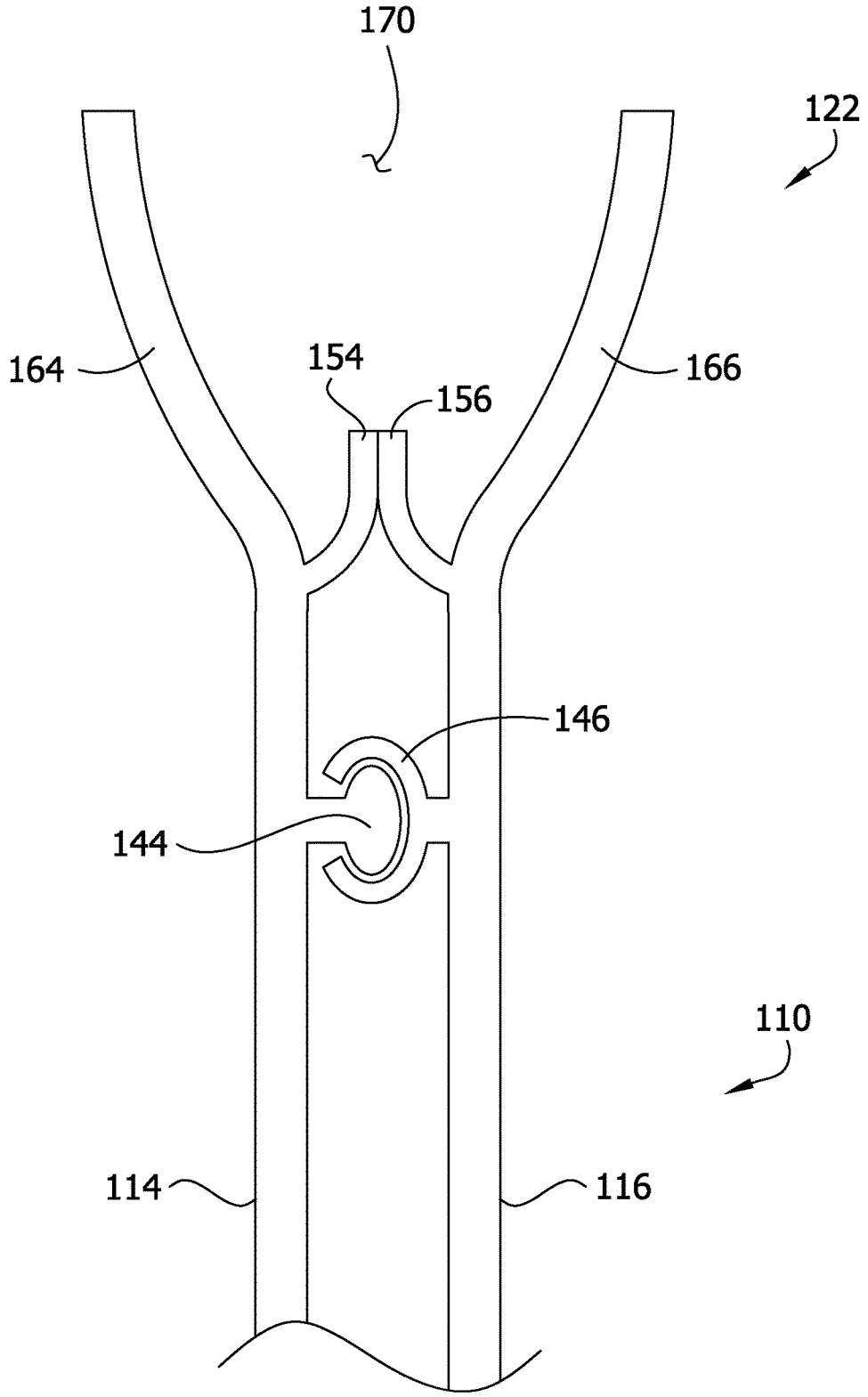
FIG. 5 is a fragmentary section similar to FIG. 3 of another embodiment of a bag.
Figure 6:
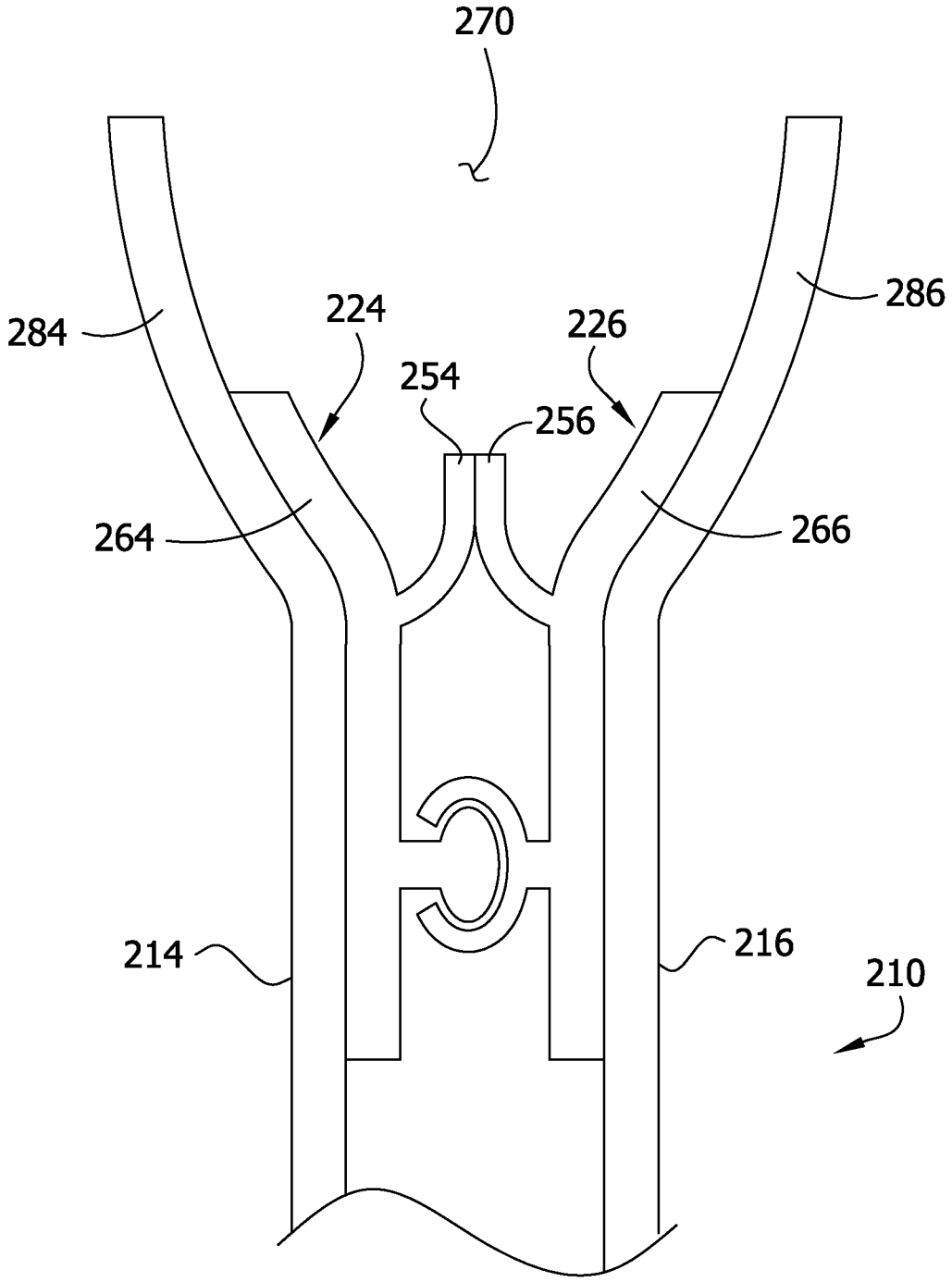
FIG. 6 is a fragmentary section similar to FIG. 3 of still another embodiment of a bag.

Although the embodiment of FIGS. 1-4 uses closure members 24, 26 that are separately attached to bag panels 14, 16 and define the gripping bands of the bag 10, other bags can be assembled differently without departing form the scope of the invention. For example, as shown in FIG. 5, in one or more embodiments of a bag 110 a closure 122 is formed as one piece of material with the bag panels 114, 116. Thus, support walls 134, 136 are flush with the bag panels 114, 116. Interlocking profiles 144, 146, grip spacing projections 154, 156, and gripping bands 164, 166 are also formed as one piece of material with the bag panels 114, 116. In another embodiment of a bag 210, the closure members 224, 226 are separately appended to the bag panels 214, 216, but the grip segments 264, 266 do not form the gripping bands of the bag. Rather, the top end portions of the bag panels 214, 216 protrude past the top end portions of the grip segments 264, 266 to form gripping bands 284, 286. Thus, when interlocking profiles 244, 246 are mated to close the bag 210, grip spacing projections 254, 256 engage one another and deflect the grip segments 264, 266 outward. The grip segments 264, 266 deflect the gripping bands 284, 286 of the bag panels 214 outward to define an enlarged gap 270, and the gripping bands function as a structure for grasping when opening the bag 210. In another embodiment (not shown), the top ends of the closure members and bag panels are aligned at the top end of the bag so that neither protrudes beyond the other. Still further, it is envisioned that there could be only one grip spacing projection that could engage a grip segment of the opposite panel when the closure is closed (not shown).

Figure 7:
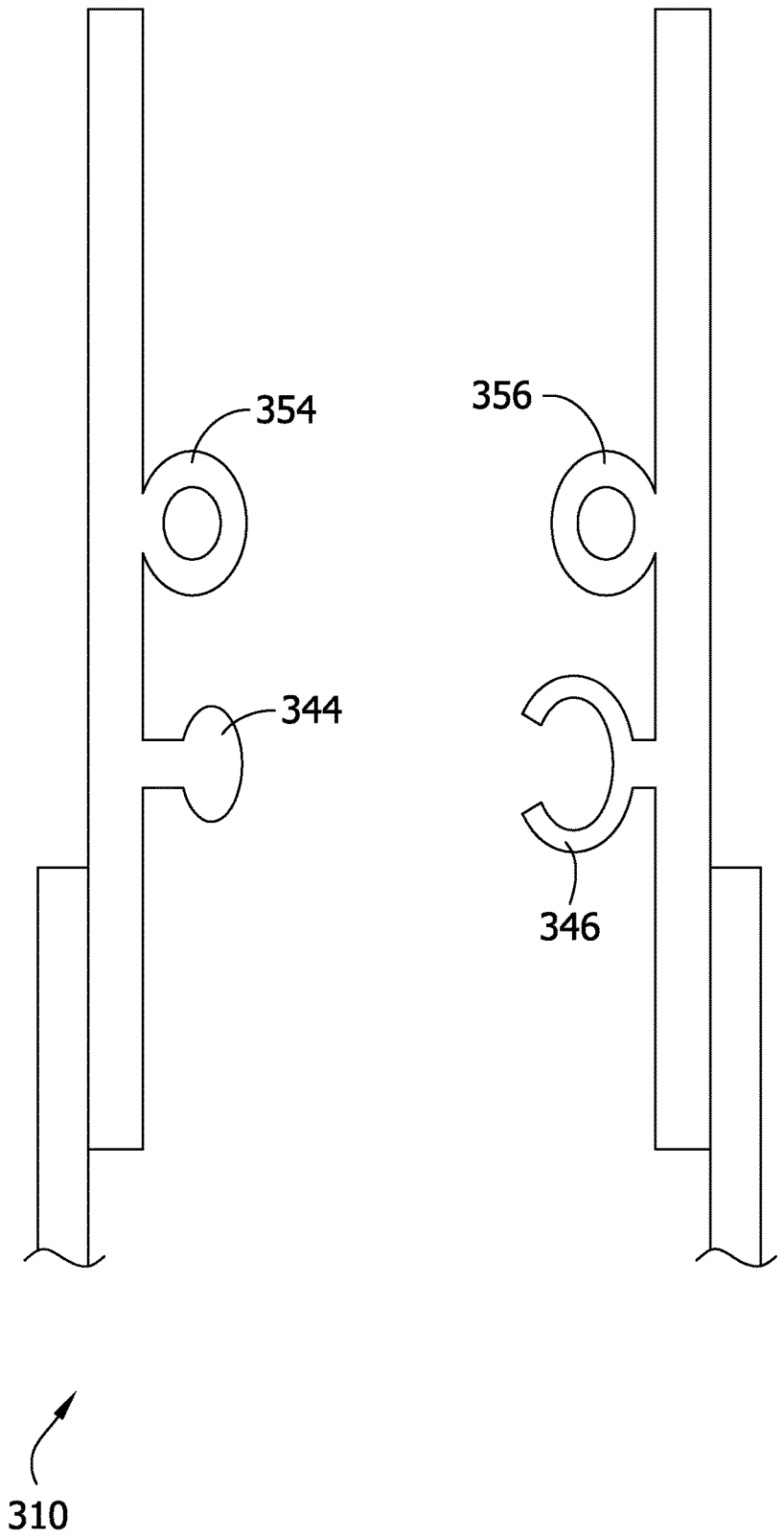
FIG. 7 is a fragmentary section similar to FIG. 4 of yet another embodiment of a bag.
Figure 8:
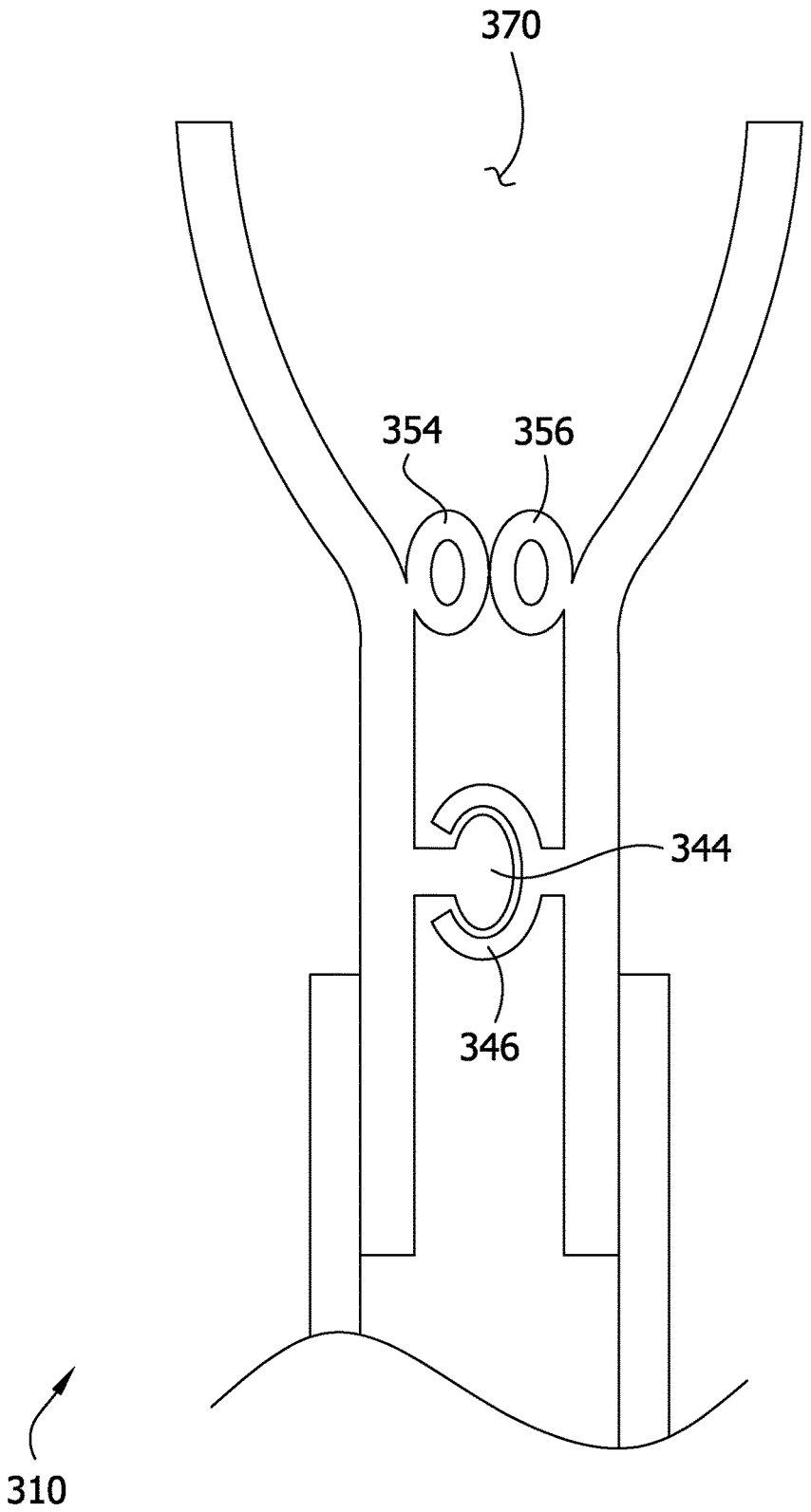
FIG. 8 is a fragmentary section similar to FIG. 3 of the bag of FIG. 7.

As discussed above, in other embodiments the grip spacing formations can have shapes besides curved projecting flaps. For example, as shown in FIGS. 7 and 8, in one embodiment, the grip spacing formations, 354, 356 are tubular projections having generally circular cross sectional shapes. In the illustrated embodiment, the projections 354, 356 are hollow, but one or both could also be solid circular formations without departing from the scope of the invention. When the interlocking profiles 344, 346 are mated to close the bag 310, the projections 354, 356 engage one another to separate the gripping bands 364, 366 and define the enlarged gap 370. The grip spacing formations 354, 356 resiliently deform from their generally circular cross sectional shapes. As a result, they push gripping bands 364, 366 apart as shown in FIG. 8. Grip spacing projections of still other shapes can also be used without departing from the scope of the invention.

In view of the foregoing, one skilled in the art will appreciate that the bags 10, 110, 210, 310 have several advantages. In use, when a bag 10, 110, 210, 310 is closed, the gripping bands form an enlarged gap 70, 170, 270, 370 that clearly identifies the structure used and provides easy access to that structure for opening the bag. Moreover, the grip spacing projections of the bags 10, 110, 210, 310 orient the gripping bands so that a user can quickly grasp each band individually to pull the closure apart. And in some embodiments, the flexible hinge joints enable separation forces to be applied on the closures in a range of directions.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above apparatuses, systems, and methods without departing from the scope of the invention, it is intended that all matter contained in the above description and shown in the accompanying drawings shall be interpreted as illustrative and not in a limiting sense.

What is claimed is:

1. A closure for selectively closing a bag, the closure comprising:

first and second closure members, each closure member comprising:

a support wall having a top end and a bottom end spaced apart along a height and a first side and a second side spaced apart along a width;

an interlocking profile extending along the width of the respective support wall at a location spaced apart from the top end of the support wall; and a grip spacing formation extending along the width of the support wall at a location spaced apart from the top end of the support wall, the support wall defining a grip segment extending between the top end of the support wall and the grip spacing formation;

the interlocking profiles of the first and second closure members being configured for selective complementary interlocking engagement to close the closure; and the grip spacing formations of the first and second closure members being sized and arranged for engaging one another and deflecting the grip segments of the first and second closure members outwardly apart from one another when the closure is closed to define an enlarged gap at the top ends of the support walls;

wherein each grip segment extends upward from the respective grip spacing formation at a living hinge, each grip segment being flexibly pivotable about the respective living hinge.

2. A closure as set forth in claim 1 wherein at least one of the grip spacing formations projects inward from the respective support wall.

3. A closure as set forth in claim 1 wherein each grip spacing formation comprises a grip spacing projection projecting inward from the respective support wall.

4. A closure as set forth in claim 3 wherein the grip spacing projections are shaped and arranged for interfering engagement with each other when the closure is closed.

5. A closure as set forth in claim 3 wherein each grip spacing projection extends inward from a joint with the respective support wall and curves upwardly toward a free end as it extends inward from the joint.

6. A closure as set forth in claim 3 wherein each grip spacing projection is resiliently biased inwardly toward a non-deflected position.

7. A closure as set forth in claim 6 wherein said engagement of the grip spacing formations deflects the grip spacing projections outward to a respective deflected position closer to the respective support wall than the non-deflected position.

8. A closure as set forth in claim 1 wherein each grip spacing formation is spaced apart from the top end of the respective support wall toward the bottom end of the respective support wall.

9. A closure as set forth in claim 8 wherein each grip spacing formation is spaced apart from the top end of the respective support wall by a first distance and from the respective interlocking profile by a second distance, the first distance being larger than the second distance.

10. A closure as set forth in claim 1 wherein each of the first and second profile members is formed as one piece of material.

11. A closure as set forth in claim 1 wherein the interlocking profile of the first closure member is a male connector and the interlocking profile of the second closure is a female connector.

12. A closure as set forth in claim 1 wherein the each of the first and second closure members is configured to be separately joined to a respective panel of the bag.

13. A closure as set forth in claim 1 wherein the closure is integrally formed with the bag.

14. A closure as set forth in claim 1 wherein the grip segments are configured to form gripping bands of the bag.

15. A closure as set forth in claim 1 wherein the grip segments are configured to be joined to gripping bands of a bag and to space the gripping bands apart from one another to define a gap for receiving a finger therein when urged outwardly apart from one another by said engagement of the grip spacing formations.

16. A bag having first and second sides spaced apart along a width and top and bottom ends spaced apart along a height, the bag comprising:

first and second panels joined together along the first and second sides and bottom ends of the first and second panels to define a bag interior and having top end portions that are not joined together to define a bag opening, each of the first and second body panels comprising:

a gripping band extending along the width of the bag at the top end portion of the respective panel;

an interlocking closure profile extending along the width of the bag and spaced from the respective gripping band toward the bottom ends of the first and second panels;

the interlocking closure profiles of the first and second panels being shaped and arranged for selective interlocking engagement to close the bag opening; and a grip spacing formation extending along the first panel widthwise of the bag, the grip spacing formation being sized and arranged to engage the second panel and deflect the gripping band of the second panel away from the gripping band of the first panel to define an enlarged gap therebetween at the top end of the bag when the closure profiles are in interlocking engagement;

wherein the gripping band of the first panel is joined to the grip spacing formation at a living hinge and is flexibly pivotable about the living hinge.

17. A bag as set forth in claim 16 further comprising a grip spacing formation extending along the second panel widthwise of the bag, at least one of the grip spacing formations projects inward toward the opposing grip spacing formation.

18. A bag as set forth in claim 16 further comprising a grip spacing formation extending along the second panel widthwise of the bag, wherein each of the grip spacing formations comprises a grip spacing projection projecting inward toward the opposing grip spacing formation, the grip spacing formations being sized and arranged to engage each other to deflect the gripping bands apart from each other to define the enlarged gap at the top end of the bag when the closure profiles are in interlocking engagement.

19. A bag as set forth in claim 16 further comprising a grip spacing formation extending along the second panel widthwise of the bag, wherein the gripping band of the second panel is joined to the grip spacing formation of the second panel at a living hinge and is flexibly pivotable about the living hinge.

20. A bag having first and second sides spaced apart along a width and top and bottom ends spaced apart along a height, the bag comprising:

first and second panels joined together along the first and second sides and the bottom end of the bag to define a bag interior and having top end portions that are not joined together to define a bag opening, each of the first and second panels comprising:

a gripping band extending along the width of the bag at the top end portion of the respective panel;

an interlocking closure profile extending along the width of the bag and spaced from the respective gripping band toward the bottom end of the bag; and a grip spacing projection extending along the width of the bag and spaced from the interlocking closure profile toward the top end of the bag, the grip spacing projection extending inward from a joint with the panel and curving upwardly toward the top end portion of the panel to a free end as it extends inward from the joint;

wherein the interlocking closure profiles of the first and second panels are shaped and arranged for selective interlocking engagement to close the bag opening; and wherein the grip spacing projections are sized and arranged to engage one another when the interlocking closure profiles close the bag opening to deflect the gripping bands of the first and second panels away from one another to define an enlarged gap therebetween.

21. A bag as set forth in claim 20 wherein each of the first and second panels comprises a body panel member and a closure member formed separately from the body panel member and attached to the body panel member.

* * * * *